US007267232B2

(12) United States Patent
Khan et al.

(10) Patent No.: US 7,267,232 B2
(45) Date of Patent: Sep. 11, 2007

(54) FLOTATION DEVICE AND METHOD OF FROTH FLOTATION

(75) Inventors: Latif Khan, Champaign, IL (US); Christopher R. Manrique, Urbana, IL (US)

(73) Assignee: The Board of Trustees of The University of Illinois, Urbana, IL (US)

( * ) Notice: Subject to any disclaimer, the term of this patent is extended or adjusted under 35 U.S.C. 154(b) by 121 days.

(21) Appl. No.: 10/836,287

(22) Filed: Apr. 30, 2004

(65) Prior Publication Data

US 2005/0242000 A1 Nov. 3, 2005

(51) Int. Cl.
*B03D 1/14* (2006.01)
*B03D 1/24* (2006.01)

(52) U.S. Cl. ..... 209/170; 209/168; 209/169; 209/724; 209/730; 209/732; 209/733; 209/734

(58) Field of Classification Search ..... 209/168, 209/169, 170, 724, 730, 732, 733, 734
See application file for complete search history.

(56) References Cited

U.S. PATENT DOCUMENTS

| | | | | |
|---|---|---|---|---|
| 1,890,708 A | | 12/1932 | White | |
| 2,322,087 A | * | 6/1943 | Atwood | 366/165.2 |
| 2,393,976 A | * | 2/1946 | Daman et al. | 209/169 |
| 2,415,650 A | * | 2/1947 | McKee | 423/528 |
| 2,582,198 A | * | 1/1952 | Etheridge | 127/28 |
| 4,097,026 A | * | 6/1978 | Haindl | 366/165.2 |
| 4,164,541 A | * | 8/1979 | Platz et al. | 422/198 |
| 4,560,474 A | * | 12/1985 | Holik | 210/221.2 |
| 4,620,926 A | * | 11/1986 | Linck et al. | 210/221.2 |
| 4,861,165 A | * | 8/1989 | Fredriksson et al. | 366/165.1 |
| 5,207,920 A | * | 5/1993 | Jones | 210/703 |
| 5,236,090 A | * | 8/1993 | Britz et al. | 209/170 |
| 5,310,459 A | * | 5/1994 | Krofta | 162/4 |
| 5,350,511 A | * | 9/1994 | Sakurada | 210/199 |
| 5,437,784 A | * | 8/1995 | Meinecke et al. | 209/170 |
| 5,540,836 A | * | 7/1996 | Coyne | 210/221.2 |
| 5,855,769 A | * | 1/1999 | Firth et al. | 209/164 |
| 6,126,836 A | | 10/2000 | Ding et al. | 210/703 |
| 6,129,212 A | | 10/2000 | Muller | 209/164 |
| 6,279,749 B1 | * | 8/2001 | Gommel et al. | 209/168 |

FOREIGN PATENT DOCUMENTS

| | | |
|---|---|---|
| DE | 3312070 | * 10/1984 |
| GB | 2246306 | * 1/1992 |
| ZA | 84-2448 | 3/1985 |

* cited by examiner

*Primary Examiner*—Thomas M. Lithgow
(74) *Attorney, Agent, or Firm*—Marshall, Gerstein & Borun LLP

(57) ABSTRACT

An apparatus for froth flotation including a flotation vessel including a side wall and a bottom wall that includes a fluid drain, and a mixing eductor inside the vessel disposed to impart net rotational force to contents of the vessel about an axis; and a method of separating a desired constituent (e.g., coal) from a mixture of particulate matter, including the steps of conditioning a liquid mixture of particulate matter including a desired constituent with a frothing agent to create a pulp, and injecting the pulp into a vessel to impart net rotational movement of pulp in the vessel, are disclosed.

45 Claims, 9 Drawing Sheets

FLOTATION DEVICE AND METHOD OF FROTH FLOTATION

BACKGROUND

1. Field of the Disclosure

The disclosure relates generally to a flotation device and a method of froth flotation for concentration or beneficiation of minerals and other particulate matter. More particularly, the disclosure relates to a flotation device including a mixing eductor and a method of froth flotation including a step of injecting pulp into a flotation vessel to impart net rotational movement of fluid in the vessel.

2. Brief Description of Related Technology

Commercially valuable substances, such as coal and minerals, are commonly found in nature mixed with relatively large quantities or prohibitive quantities of unwanted substances. As a consequence, it is usually necessary to beneficiate or clean ores to concentrate a desired substance or, put another way, reduce the content of an unwanted substance. Similarly, recycling processes, such as de-inking of paper fibers, involve the separation of a desired substance (paper fibers) from an unwanted substance (ink).

Mixtures of finely-divided product particles and finely-divided waste particles can be separated and concentrates obtained therefrom by froth flotation techniques. Generally, froth flotation involves conditioning a liquid, commonly aqueous, pulp (or slurry) of the mixture of product and waste particles with one or more frothing agents and optional reagents, and aerating the pulp. The conditioned pulp is aerated by introducing into the pulp a plurality of gas (typically, air) bubbles which tend to become attached to either the product particles or the waste particles, thereby causing these particles to rise and generate a float fraction of froth on the surface of a non-float fraction of pulp. The difference in density between air bubbles and water provides buoyancy that preferentially lifts hydrophobic solid particles to the surface. The desired constituent of the mixture may be concentrated in the froth or in the tailings.

Froth flotation is often used to separate solids of similar densities and sizes, which factors prevent other types of separations based on gravity that might otherwise be employed. It is especially useful for particle sizes below about 100 μm (about 150 mesh), which are typically too small for gravity separation using jigging and tabling. The lower-size limit for flotation separation is typically about 35 μm (about 400 mesh). At smaller particle sizes, it becomes difficult to take advantage of surface-property differences to induce selective hydrophobicity. On the other hand, particles greater than about 200 μm (about 65 mesh) tend to be readily sheared from bubble surfaces by collision with other particles or vessel walls.

Today, at least 100 different minerals, including almost all of the world's copper, lead, zinc, nickel, silver, molybdenum, manganese, chromium, cobalt, tungsten, and titanium, are processed using froth flotation. Another major usage of froth flotation is by the coal industry for desulfurization and the recovery of fine coal, once discarded as waste. Since the 1950's, flotation has also been applied in many non-mineral industries including sewage treatment; water purification; paper de-inking; and chemical, plastics, and food processing.

In conventional subaeration cells, the pulp ordinarily is aerated by means of a mechanical impeller-type agitator and aerator which extends down into the body of pulp and which disperses minute bubbles of air throughout the body of pulp by vigorous mechanical agitation of the pulp.

In conventional froth-flotation columns, air for aeration is introduced directly into a relatively quiescent body of pulp by means of an air diffuser or sparger which is immersed in or in direct contact with the pulp, or by introduction of pre-aerated water, e.g. from below a flotation compartment.

Generally, subaeration cells have a relatively higher throughput than froth-flotation columns, but froth-flotation columns can provide better separation between desired and undesired components. As a consequence, when both high throughput and good separation are desired, subaeration cells typically are used in series and froth-flotation columns are used in parallel. In some cases, the flotation operations are conducted in stages wherein the concentrate obtained from the float fraction in one stage can comprise a different substance from the concentrate obtained from the float fraction in another stage.

Typical undesired impurities in coal include pyrite, sulfur, and other ash-forming mineral matter. Pyrite in many U.S. coals occurs in large quantities as fine-grained matter varying in size between 20 microns (μm) and 32 μm. In some coals, such as is available in Illinois, a significant part of the pyrite is less than 20 μm. To make use of these types of coals more fully, a coal cleaning method capable of processing very finely ground coal in which most of the pyrite particles have been liberated must be used. Similarly, reduction in or removal of ash-forming matter can improve marketability and heat content of cleaned coals, because ash is incombustible and has been linked to poor heat exchange and reduced boiler performance.

In addition, because every coal mine and preparation plant produces fines in the course of extracting and processing coal, failure to recover coal from fines increases the proportion of produced coal that is discharged into the environment (e.g., into tailing ponds) which results not only in a loss of potential revenue but also in an environmental impact.

The separation of fine particles by froth flotation techniques presents particular obstacles which are only overcome with great difficulty and cost by known techniques, such as use of multiple machines in series or parallel, and known techniques still have limitations in the degree of separation which can be achieved.

Thus, it is a continuous goal in the industry to have methods and apparatus which improve the separation of desired particulate matter from undesired particle matter.

SUMMARY

One aspect of the disclosure provides an apparatus for froth flotation including a flotation vessel including a side wall and a bottom wall that includes a fluid drain, and a mixing eductor inside the vessel disposed to impart net rotational force to contents of the vessel about an axis.

Another aspect of the disclosure provides a method of separating a desired constituent (e.g., coal) from a mixture of particulate matter, including the steps of conditioning a liquid mixture of particulate matter including a desired constituent with a frothing agent to create a pulp, and injecting the pulp into a vessel to impart net rotational movement of pulp in the vessel.

Further aspects and advantages will be apparent to those of ordinary skill in the art from a review of the following detailed description, taken in conjunction with the drawings. While the apparatus and method are susceptible of embodiments in various forms, the description hereafter includes specific embodiments with the understanding that the disclosure is illustrative, and is not intended to limit the invention to the specific embodiments described herein.

BRIEF DESCRIPTION OF THE DRAWINGS

For further facilitating the understanding of the present invention, six drawing figures are appended hereto, wherein.

DETAILED DESCRIPTION

Figure 1:
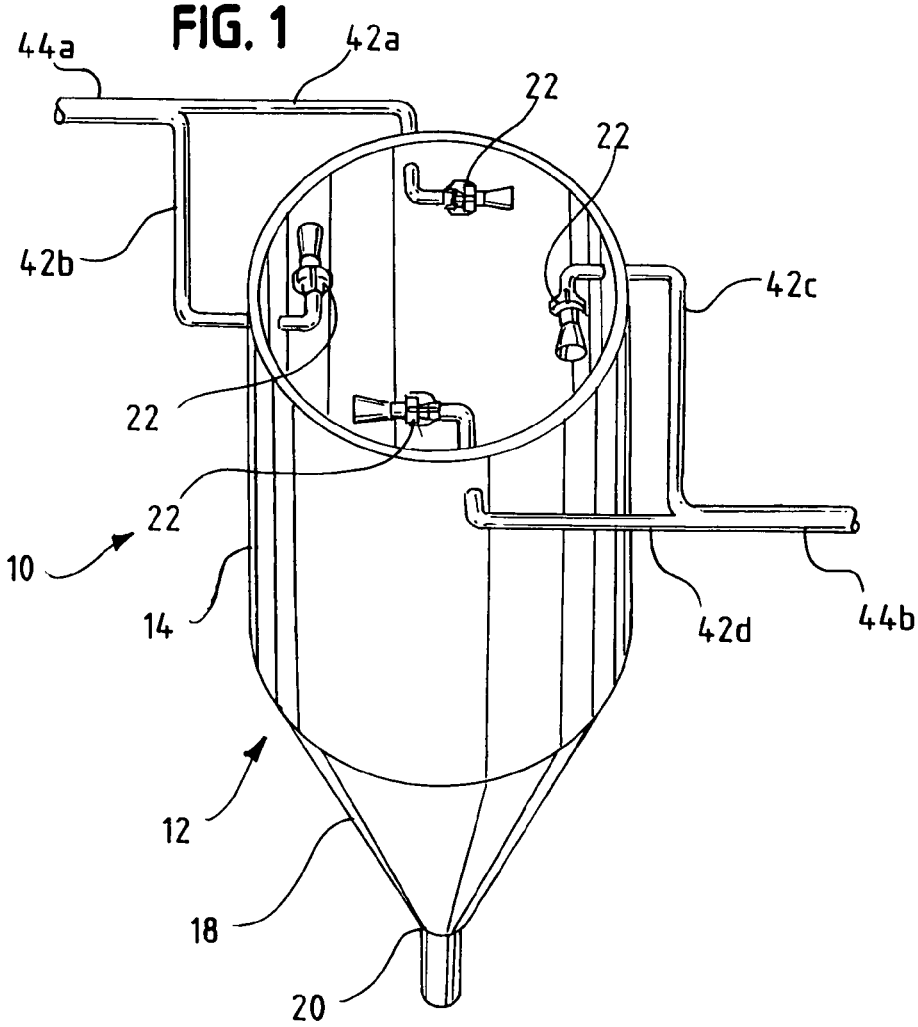
FIG. 1 is a perspective view of an embodiment of a froth flotation apparatus with mixing eductors.

As described above, hydrophobic particles suspending in an aqueous media attach to air bubbles preferentially and are buoyed. To ensure that hydrophobic particles attach to air bubbles, the must be brought together, and the probability of attachment depends on the probability of collision. The more often the hydrophobic particles and the bubbles collide, the greater is the probability of attachment and removal of the hydrophobic particles.

To enhance the probability of collision, a gas (typically air) is mixed with a pulp mixture of particles, water, and frothing agent. In typical processes and apparatus, air is mixed with the pulp either through mechanical means (as in mechanical flotation cells), or by utilizing counter-current flow (as in flotation columns). Mechanical agitation typically requires a relatively large amount of work energy, and is costly. The apparatus and method described herein have one or more advantages including enhancing collision between air bubbles and solid particles, and separating particle-loaded froth from pulp. The apparatus and method described herein are particularly suited for fine particulate matter, such as mixtures of coal fines. The mixture of particulate matter is not limited to any specific particle sizes; however, the method and apparatus disclosed herein offer significant advantages over known methods of processing mixtures with very fine particle sizes, such as less than 5 mm (e.g., less than 3, 2, or 1 mm, or less than 0.65 mm).

The apparatus for froth flotation includes a flotation vessel including a side wall and a bottom wall that includes a fluid drain, and a mixing eductor inside the vessel disposed to impart net rotational force to contents of the vessel about an axis, in use, the mixing eductor including a primary fluid inlet and a secondary fluid inlet, as further described below. Typically, the vessel will be disposed with the side walls perpendicular to the ground in use, although in some applications the vessel may be tilted. The apparatus is contemplated to include embodiments including any combination of one or more of the additional optional elements and features further described below (including those elements and features shown in the figures), unless stated otherwise.

Mixing eductors are known in the art and commercially available, and generally include a primary fluid inlet through which feed passes, and a secondary fluid inlet through which fluid is drawn for entrainment with the feed fluid. In operation, the mixing eductor will be at least partially submersed in pulp, preferably completely submersed in pulp. The secondary fluid inlet of the mixing eductor may have a variable or fixed area. Preferred mixing eductors include a venturi section for intense mixing of the primary feed fluid and entrained fluid.

Mixing eductors can be of a fixed configuration and size, with having a fixed flow ratio of primary feed to secondary (entrained) feed, or the ratio of primary to secondary feed can be variable. The eductors and associated feed apparatus can include simple coupling of plumbing connections to allow for rapid and easy substitution of eductors within a vessel.

A mixing eductor is disposed in the vessel to impart net rotational force about an axis to fluid in the vessel. It is further contemplated that the mixing eductor can be disposed in the vessel to impart both net rotational and net vertical (with respect to the gravity vector) force to fluid in the vessel. For example, and as described in additional detail below, the mixing eductor can be disposed to create net cyclonic movement of fluid in the vessel wherein froth rises towards the center of the vessel and reject pulp descends towards the center of the vessel. Preferably a plurality of mixing eductors are included, and when the disclosure herein refers to a single eductor a plurality of eductors is also contemplated. The eductor preferably is disposed in a fixed position and orientation, although variable orientation of the outlet flow axis is contemplated.

The selection of the location of eductors for discharge into the cell can be made to take maximum advantage of the pressure differential for recirculation of the portion of feed most likely to benefit. Discharge of new feed into the flotation vessel can be performed in the center of the cell, at the wall of the cell, or in between. Likewise, the eductors can be located any desired height within the vessel. If the discharge into the vessel is located in an area where the contents of the vessel, due to the pressure gradient, has very little reject material and a large amount of desired constituent (e.g., coal) attached to froth, then the discharge will be mixing relatively dirty feed with a clean product, achieving lower efficiency of separation. Conversely, if the discharge point is located in an area of the vessel where there is very little desired constituent, there would be little benefit from the additional mixing that the eductors provide, as there is little material of value that could be recovered. Thus, one or more discharge points should be selected to gain maximum benefit from the mixing produced by the eductor, preferably where the pulp contains a desired constituent not yet attached to froth, such that the mixing action provides additional opportunity for collisions between the bubbles and the desired constituent.

The choice of orientation of the mixing eductor can be influenced to some extent on the configuration of the vessel, including its walls and any other objects disposed in the fluid flow area of the vessel. In a vessel having a curvilinear cross-sectional side wall (or a vessel having a rectilinear cross-sectional side wall having many sides such that its cross section approaches a curvilinear shape), a mixing eductor can be disposed off-center and roughly tangential to the side wall to impart net rotational force about an axis to fluid in the vessel. In a vessel having a rectilinear cross-sectional side wall of relatively few sides (e.g., a square), a mixing eductor can be disposed off-center and with its outlet flow axis biased toward the center of the vessel to avoid perpendicular intersection with a side wall. One or more deflectors can also be disposed in a vessel, especially a vessel having a rectilinear cross-sectional side wall of relatively few sides, such that a mixing eductor will impart net rotational force about an axis to the contents of the vessel.

The eductor preferably is disposed off-center. For example, the eductor can be disposed within the outer 70% of the mean radius or less of the vessel (e.g., within the outer 40%, 20% or 10% of the mean radius). The eductor can also be adjacent to the vessel side wall. In a preferred arrangement, the eductor is integrated with the vessel side wall to reduce drag and improve hydrodynamic conditions within the vessel.

Preferably, the mixing eductor is disposed with its outlet flow axis horizontal (or perpendicular to the gravity vector) or at least substantially horizontal. For example, the mixing eductor can be disposed with its outlet flow axis within 45 degrees of horizontal in either direction, or less (e.g., 30 degrees, 15 degrees, or 5 degrees). If more than one mixing eductor is used, the eductors can be disposed in the same or different angles with respect to horizontal, and preferably the same or substantially the same angle (e.g., within 5 degrees), although in some cases it may be desirable to orient one or more eductors vertically up or down.

In one arrangement, the mixing eductor is disposed with its outlet flow axis parallel to or tangential to the vessel wall. In another arrangement, the outlet flow axis of an eductor can be biased toward the center of the vessel (preferably less than 90 degrees, such as 60 degrees or less or 30 degrees or less). The outlet flow axis of an eductor can be biased toward the center of the vessel at an angle up to 90 degrees so long as the apparatus includes one or more other eductors not so biased such that net rotational force is imparted to the contents of the vessel.

The mixing eductor can be disposed at any height within the vessel, and preferably is disposed towards the middle of the vessel. Thus, for example, the eductor is disposed within the middle 80% or less of the mean interior height of the vessel (e.g., 60%, 40%, or 20% or less of the mean interior height of the vessel). If a series of eductors is included, they can be disposed on the same plane (e.g., in circular fashion), on different planes, or both. A preferred arrangement includes a series of eductors on at least two different levels (i.e., at two different heights).

The mixing eductor can be constructed of any suitable material for the pulp desired to be processed, such as metals, plastics, and any combination thereof.

As described above, the vessel shape can also assist in the eductors imparting the desired net forces. The vessel side wall preferably has a regular curvilinear cross section, such as circular. For example, the side wall can form a cylinder. The vessel bottom wall preferably defines a depressed bottom of the vessel, and preferably is tapered. The drain preferably is located in or around the lowest point of the vessel bottom, although it can also be located in a location above the absolute bottom. The vessel bottom preferably is conically-shaped (e.g., in the shape of an inverted pyramid if rectilinear or a cone if curvilinear). Other contemplated shapes include paraboloids and spheroids. A preferred vessel bottom is a right regular truncated cone having a drain at its lowest point.

In a vessel having a conical vessel bottom, the mean half-cone angle is preferably less than 85 degrees (e.g., less than 75, 60, or 45 degrees), and preferably greater than 5 degrees (e.g., greater than 10, 15 or 30 degrees). A half-cone angle is the angle between the rotational symmetry axis and the surface of the cone. If a conical-shaped object is irregular, then a mean half-cone angle serves as a useful approximation (for a regular conical object, the mean half-cone angle equals the half-cone angle at any given radius).

The vessel can also include a top wall, which, when present, preferably is raised. The vessel top can be domed or angled. The vessel top preferably is tapered, to reduce collection of air pockets above the froth/fluid interface.

The top wall includes an outlet orifice for the passage of froth. The outlet can be of any suitable shape, such as for interface with a froth collector. In a preferred top wall, the froth outlet intersects the axis about which the eductor imparts net rotational force to fluid in the vessel. For example, if the vessel side wall is a regular cylinder and fluid rotates in circular fashion, then preferably the froth outlet in the top wall is in the center of the top wall. The froth outlet in the top wall can include a froth collector, such as a conduit or froth washer as described below or in U.S. patent application Ser. No. 10/306,131. The froth outlet can have any shape suitable for efficiently collecting the froth outlet flow.

In a preferred vessel having a domed top, cylindrical side wall, and conical bottom, pulp is fed to eductors disposed within the cylindrical section of the vessel. The shape of the vessel forces reject pulp downward, while guiding froth (e.g., coal-laden froth) to the center of the domed roof where it can be trapped and pushed into a conduit for collection and, optionally, further processing such as washing.

As described above, one or more deflectors can be disposed in the vessel to alter fluid flow. For example, one or more deflectors can be disposed in a vessel having a rectilinear cross section to reduce drag in corners. One or more deflectors can also be disposed in or adjacent the fluid drain to disrupt the formation of a vortex which might otherwise pull high value pulp and/or froth from higher layers within the vessel more directly into the drain. A suitable deflector has a cross-section in the shape of a square cross, and is disposed in the drain, adjacent the drain (e.g., just above or to the side of the drain), or both in and above the drain, for example.

The vessel can be constructed of any suitable material or combinations of materials. Use of the eductor (e.g., rather than a rotor) is contemplated to permit the use of plastic materials of construction for the vessel, rather than typical metals. Facilitating use of plastics can allow the vessel to be lightweight and relatively inexpensive. The various walls of the vessel can be can be formed as a single piece, or can be made of individual pieces joined in sealing relationship. More abrasion-resistant materials of construction or coatings may be used in zones of injection and intense mixing. One or more of the walls may include a viewing window if the materials of construction are opaque.

The primary fluid inlet of the eductor is in fluid communication with a feed conduit for flow of feed pulp. One or more eductors can be fed from a single feed conduit, each eductor may have its own feed conduit, or several feed conduit may feed several eductors. The feed conduit can enter the vessel at any location. For example, the feed conduit can enter through the side wall, e.g., perpendicular to the side wall. The feed conduit can also be disposed parallel to the vessel side wall, for hydrodynamic purposes, and further can enter the vessel interior from above or below (e.g., through the vessel bottom or through the vessel top, if present).

The apparatus can include a pump to pressurize a supply of pulp for transport through the eductor and any associated optional apparatus, such as aerators and static mixers. Various pumps are known in the art and are commercially available.

The apparatus can include any means for aerating pulp, such as those known for use with subaeration cells (e.g., an impeller-type agitator and aerator) and froth froth-flotation columns (e.g., an air diffuser or sparger). Preferably, the vessel is free of mechanical agitators disposed in the vessel. An aerator can be disposed in any suitable location to aerate pulp. The pulp preferably is aerated before it is introduced into the vessel, such as by means of an aspirator or injector (e.g., a jet pump). For example, one or both of an aspirator and an injector can be associated with a feed conduit, a static mixer, or both.

The apparatus preferably includes a static mixer, which is preferably disposed preceding (i.e., upstream of, in use) the eductor and further preferably following (downstream of, in use) an aerator, when used. Static mixers are known in the art and are commercially available. In addition, a length of conduit, preferably non-linear conduit, can serve as a static mixer. Preferably the conduit will include a constriction to enhance mixing.

The apparatus can also include one or more associated control devices, including, but not limited to, sensors (e.g., pressure sensors, level sensors, ultrasonic sensors, overflow sensors), programmable controllers, control valves, pressure valves, and the like.

A suitable embodiment of the apparatus is shown in FIG. 1 in perspective view. The froth flotation apparatus 10 includes a vessel 12 including a side wall 14 forming a cylindrical section of the vessel and a bottom wall 18 forming a conical, depressed vessel bottom. A drain 20 including a conduit is shown at the lowest portion of the bottom wall 18. The side wall 14 and bottom wall 18 of the vessel 12 can be integrally-formed or joined in sealing relationship.

Figure 2:
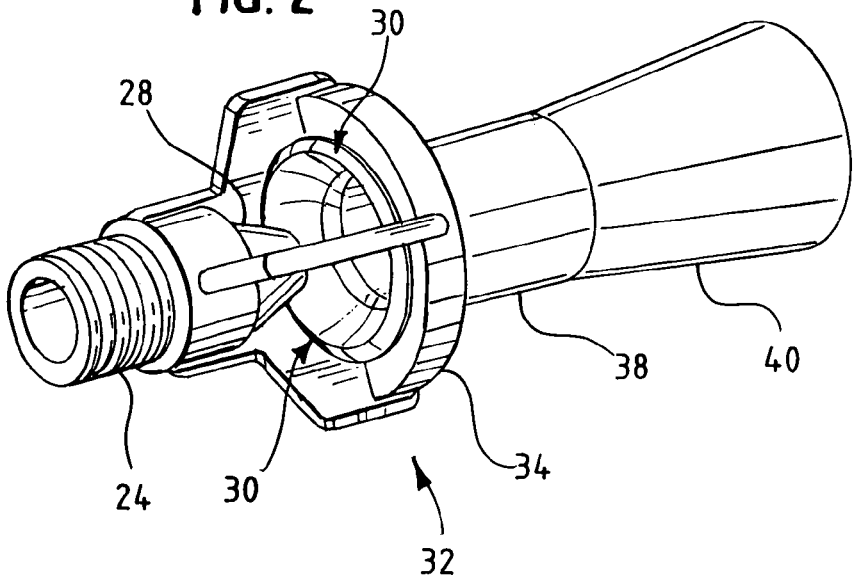
FIG. 2 shows a typical mixing eductor.

Disposed inside the vessel 12 are mixing eductors 22. FIG. 2 shows a typical eductor 22 having a primary fluid inlet 24 including a motive jet nozzle 28, secondary fluid inlets in the form of ports 30, and a venturi section 32 including a mixing chamber 34, a parallel section 38, and a diffuser 40.

The eductors 22 shown in FIG. 1 are disposed horizontal and are oriented tangential to the vessel wall 14 to impart net rotational force to contents of the vessel about an axis, in use. The eductors 22 shown are fixed to the side wall 14, through which non-linear feed line conduits 42 pass and are attached in fluid communication with the eductors 22. The feed line conduits 42*a* and 42*b* are shown branched from a common feed line conduit 44*a,* and feed line conduits 42*c* and 42*d* are shown branched from a common feed line conduit 44*b.* Conduits 44*a* and 44*b* can be fed from individual pumps or a common pump (not shown).

Figure 3:
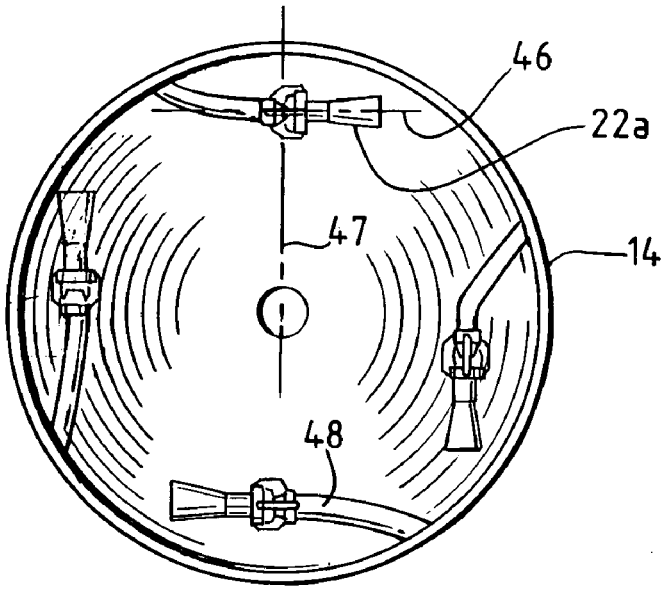
FIG. 3 is an elevation view of an embodiment of a flotation vessel having four mixing eductors and associated feed apparatus.

FIG. 3 is a top-view of the apparatus of FIG. 1, illustrating an arrangement of eductors 22 in a vessel having a side wall 14 of circular cross-section. Four eductors 22 are shown oriented tangential to the side wall 14 to impart net circular rotational force to contents of the vessel about an axis, in use. For example, the outlet flow axis 46 of the eductor 22*a* is perpendicular to a radius 47 which passes through the eductor (e.g., preferably through its midpoint). The eductors 22 are in fluid communication with internal feed conduits 48 disposed inside the vessel which are shaped (curved) to minimize drag and be hydrodynamically aligned to minimize turbulence and erosion.

Figure 4:
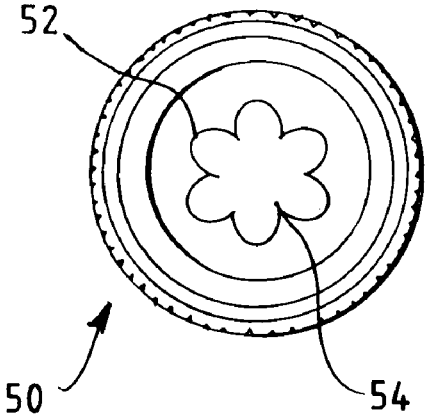
FIG. 4 is a front view of a static mixer.
Figure 5:
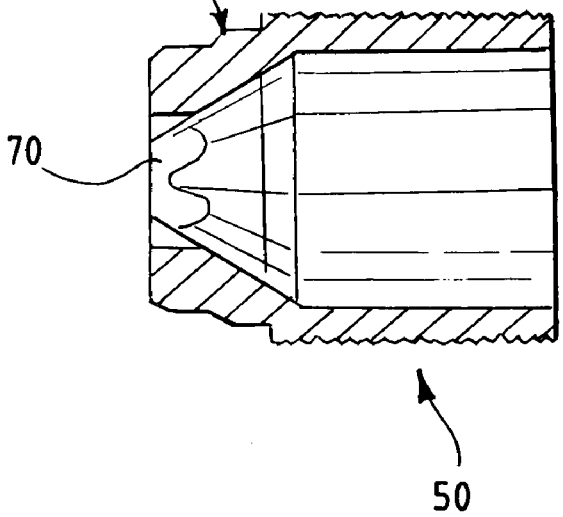
FIG. 5 is a side view of a static mixer.

FIGS. 4 and 5 are front and cross-sectional side views of a static mixer 50 suitable for use in the apparatus and method described herein. FIG. 4 shows lobes 52 of the mixer which generate radial flow and a core 54 of the nozzle 58 orifice 70 which produces axial flow.

Figure 6:
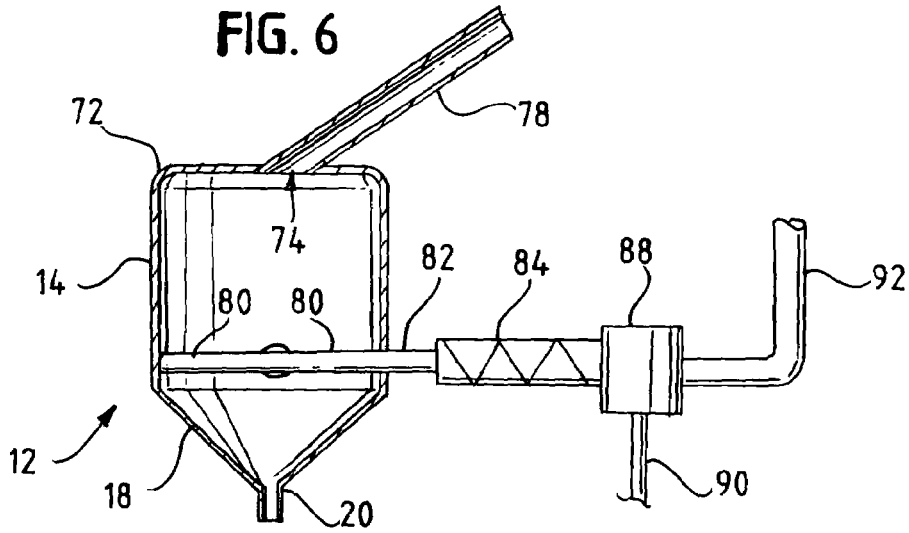
FIG. 6 is a side view of an embodiment of a froth flotation apparatus with associated apparatus for feed, mixing and aeration.

FIG. 6 is a side view of an apparatus including a vessel 12 including a side wall 14 forming a cylindrical section of the vessel, a bottom wall 18 forming a conical, depressed vessel bottom, and a top wall 72 forming a domed top of the vessel. The domed top of the vessel includes an orifice 74 connecting the interior of the vessel to an upwardly-inclined chute 78 for collecting and draining froth. The chute 78 can include one or more spray washers (not shown) for washing collected froth.

Mixing eductors (not shown) disposed inside the vessel 12 are connected to and fed by feed conduits 80 disposed about the exterior circumference of the vessel 12, which are fed from a common feed conduit 82. Upstream of the conduit 82 is a static mixer 84, which is preceded by a jet pump 88 connected by conduits 90 and 92 to sources of air and pulp (not shown), respectively.

Figure 7:
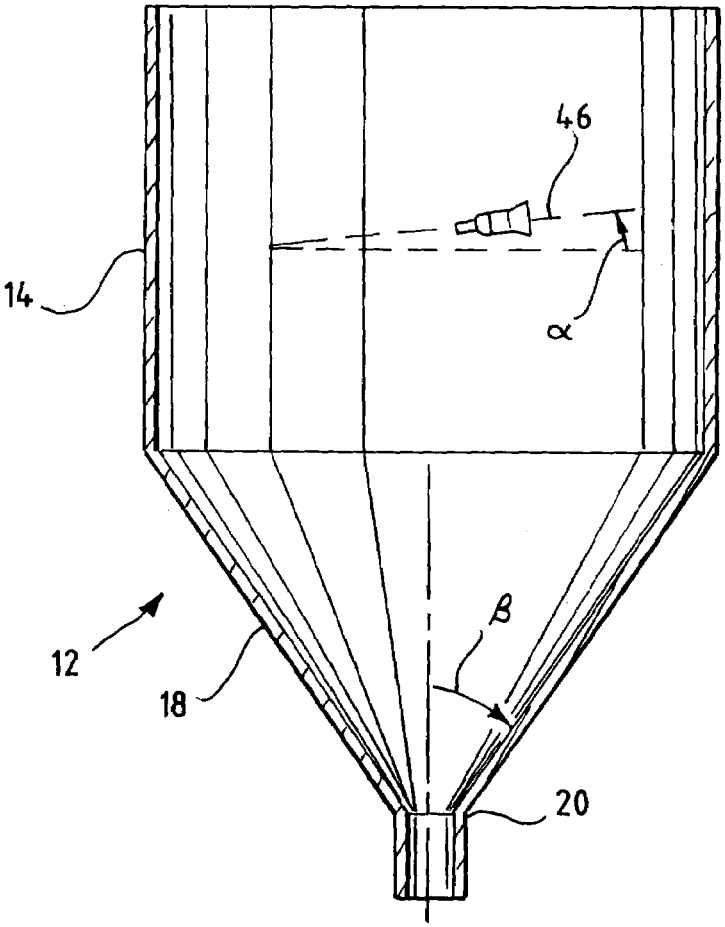
FIG. 7 is a cross-sectional view illustrating orientation of a mixing eductor and configuration of a conical vessel bottom.

FIG. 7 is a cross-sectional view of an apparatus according to the disclosure showing a vessel 12 including a side wall 14 forming a cylindrical section of the vessel, a bottom wall 18 forming a regular conical, depressed vessel bottom. An eductor 22 is shown disposed at a positive angle $\alpha$ with respect to horizontal. The conical vessel bottom is shown with a half-cone angle $\beta$.

Figure 8:
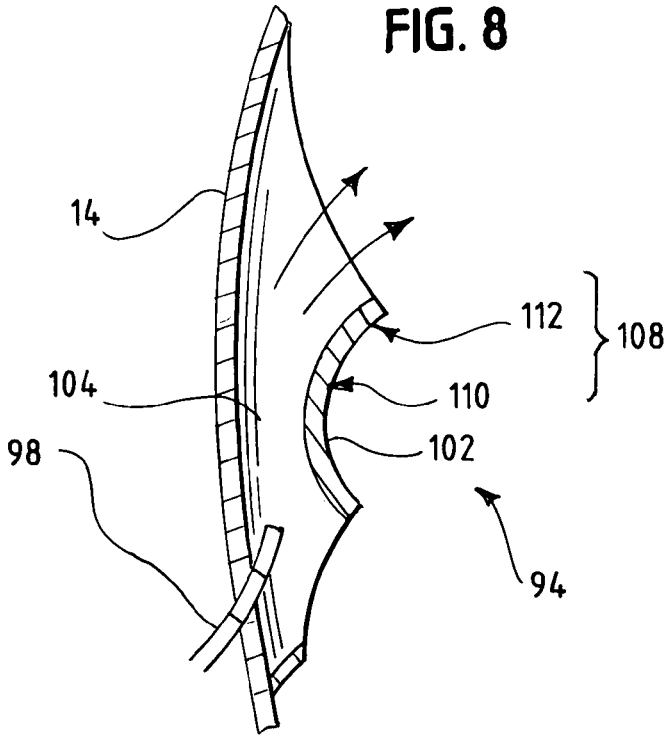
FIG. 8 is an elevation view of an embodiment of an integrated mixing eductor.

FIG. 8 is a top cross-sectional view of an integral eductor 94 which is integral with (e.g., by molding) a side wall 14 of a flotation vessel. The eductor has primary 98 and secondary 100 feed inlets. A side wall 102 of the eductor together with the side wall 14 of the flotation vessel form a mixing chamber 104, and a venturi section 108 including a constricted portion 110 and a diffuser portion 112. Flow of pulp from inside the vessel, through the eductor 94, and back into the vessel is shown with arrows.

Figure 9:
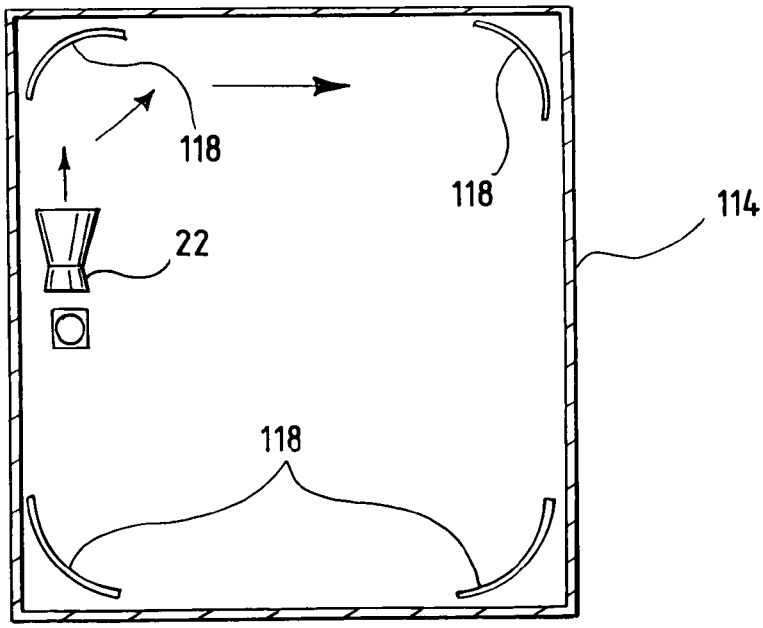
FIG. 9 is an elevation view of an embodiment of a flotation apparatus including curved side wall deflectors.

FIG. 9 shows an embodiment of a vessel having a square side wall 114 and deflectors 118. A top-fed eductor 22 is disposed in the vessel with respect to the deflectors 118 and side wall 114 to impart net rotational force to pulp in the vessel about an axis.

Figure 11:
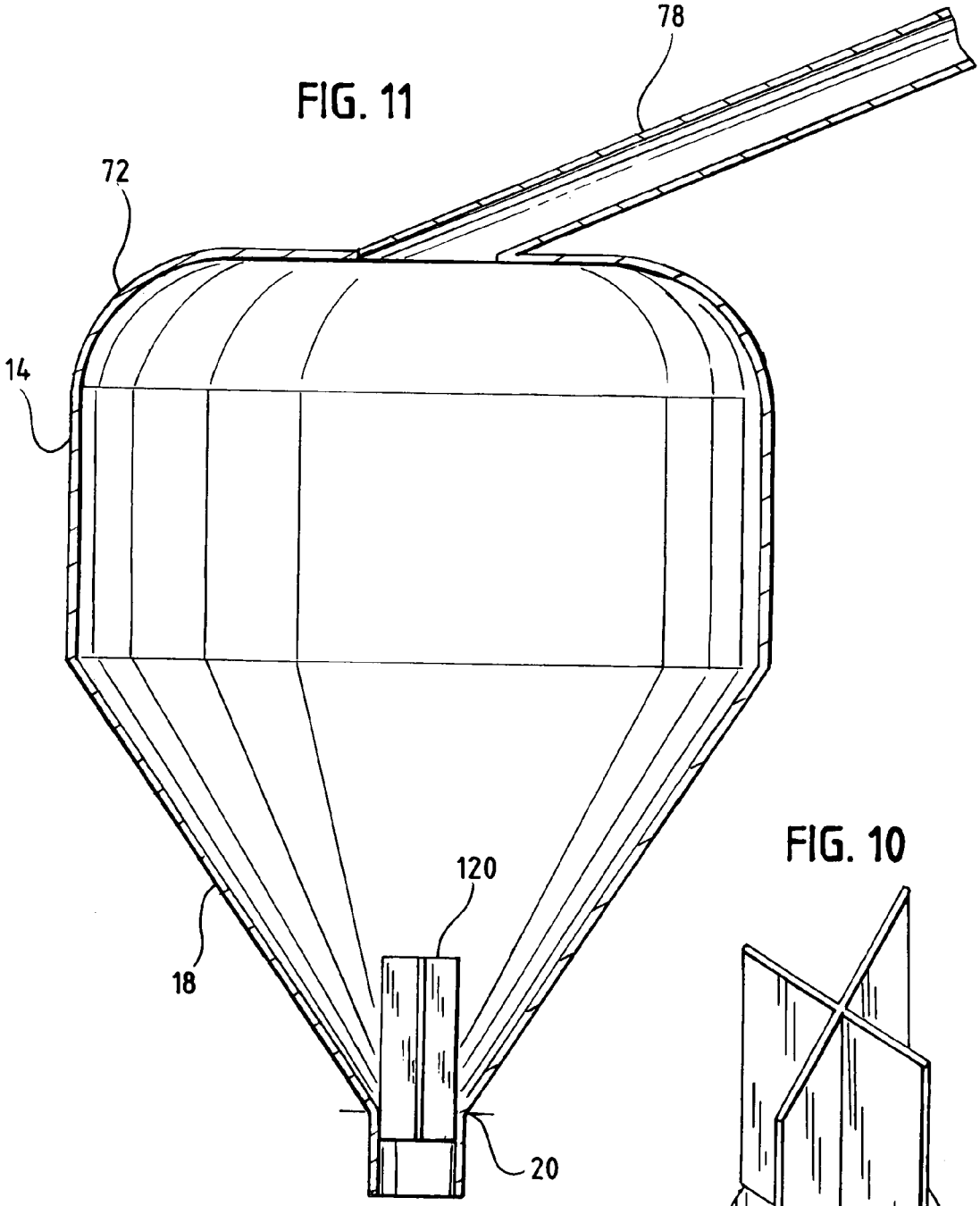
FIG. 11 is a cross-sectional view of a vortex disrupting deflector disposed in a preferred location in a flotation apparatus.
Figure 10:
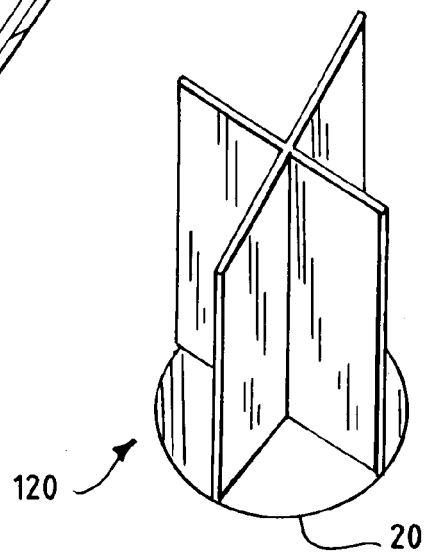
FIG. 10 is a perspective view of a vortex disrupting deflector.

FIG. 10 shows a perspective view of a vortex disrupting deflector 120 alone, and FIG. 11 shows the deflector as disposed in and adjacent a drain 20 in a froth flotation vessel.

Figure 12:
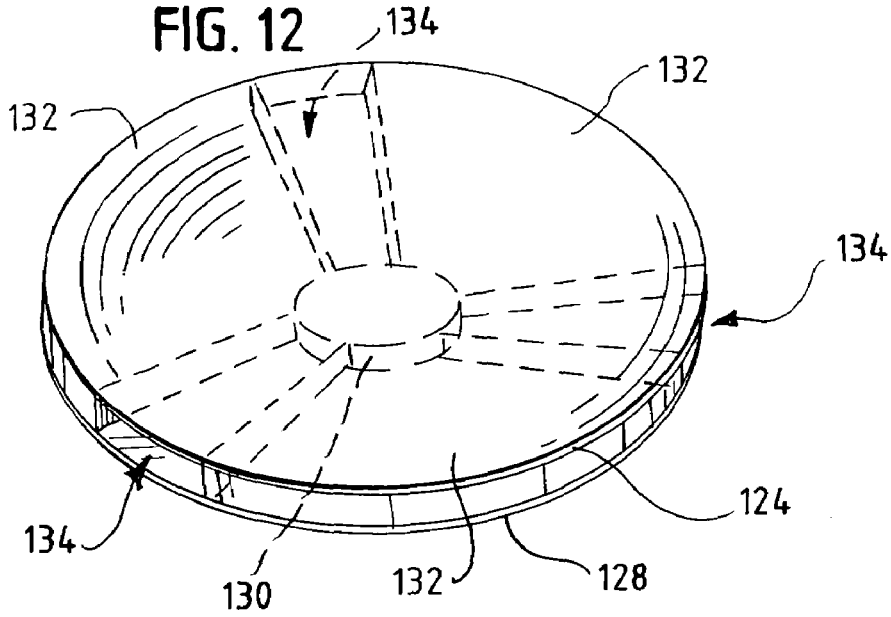
FIG. 12 is a perspective view of a froth collector.

FIG. 12 shows a perspective view of a circular froth collector 122 having a circular bottom top wall 124 and a circular bottom wall 128 which allows for relatively high volume throughput of froth by tapping into a larger cross section of froth. The bottom wall 128 has a froth inlet orifice 130 (shown in phantom lines) for interface with a froth outlet orifice (not shown) of a flotation vessel having a top wall. The froth collector has interior blocked zones 132 to form hollow froth paths 134 bounded by the zones 132 and top and bottom walls 124 and 128, respectively. At least the bottom wall 128 can be upwardly-inclined to promote drainage of froth. One or more wash sprayers (not shown) can be disposed to spray a fluid onto or into froth which passes through a froth path 134. Froth can be recovered from the outlets of the paths 134.

Figure 13:
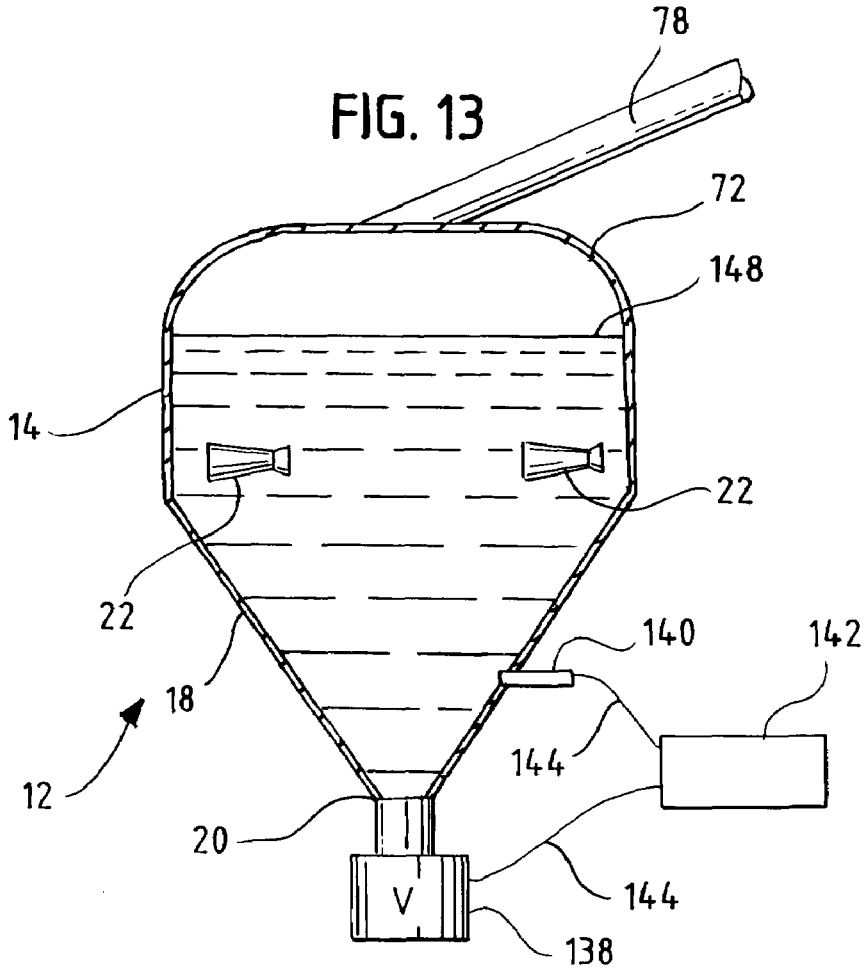
FIGS. 13-15 are illustrations showing a flotation apparatus and with auxiliary apparatus for controlling froth flotation.

FIG. 13 shows a flotation apparatus including auxiliary apparatus for controlling a froth flotation process. The auxiliary apparatus includes a control valve 138 in operational relationship with the drain 20, a pressure sensor 140 disposed in operational relationship with the interior of the vessel 12, and a programmable controller 142. The programmable controller 142 is connected by signal carriers 144 (e.g., pneumatics and/or electronics) to the pressure sensor 140 and control valve 138. The programmable controller 142 receives a signal from the pressure sensor 140 indicative (e.g., via an algorithm) of the pulp level 148 in the tank and, when necessary, sends a signal to the control valve 138 to adjust the operational position of the control valve 138 to control outlet flow.

Figure 14:
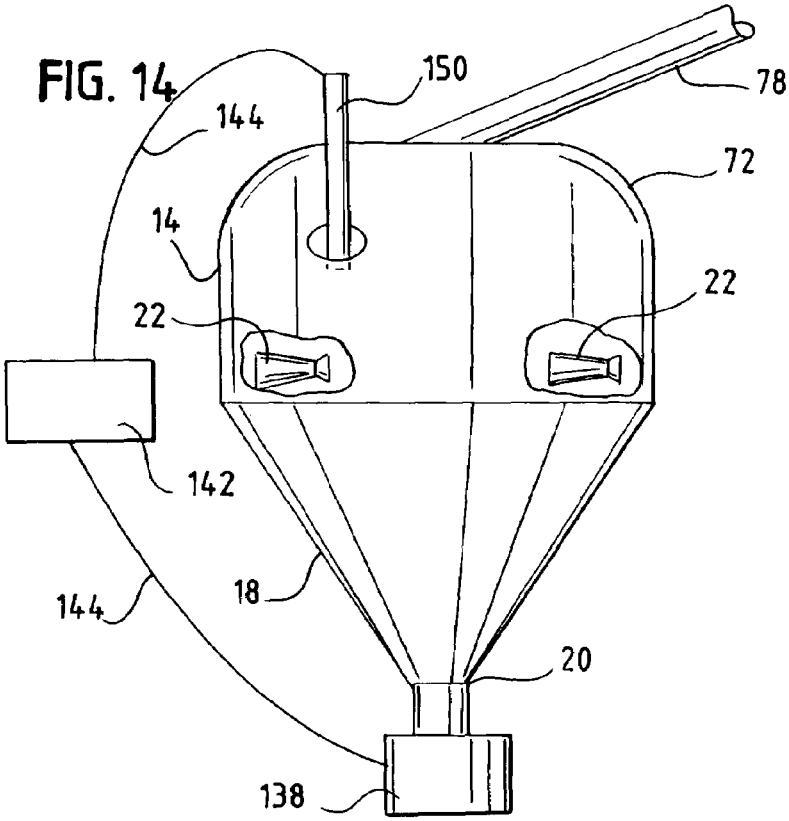

FIG. 14 shows a flotation apparatus including somewhat different auxiliary apparatus for controlling a froth flotation process, with cutaways showing mixing eductors 22 disposed in the vessel. The auxiliary apparatus instead includes a float sensor 150 disposed in operational relationship with the interior of the vessel 12. The programmable controller 142 receives a signal from the float sensor 150 indicative (e.g., via an algorithm) of the pulp level (not shown) in the tank and, when necessary, sends a signal to the control valve 138 to adjust the operational position of the control valve 138 to control outlet flow.

Figure 15:
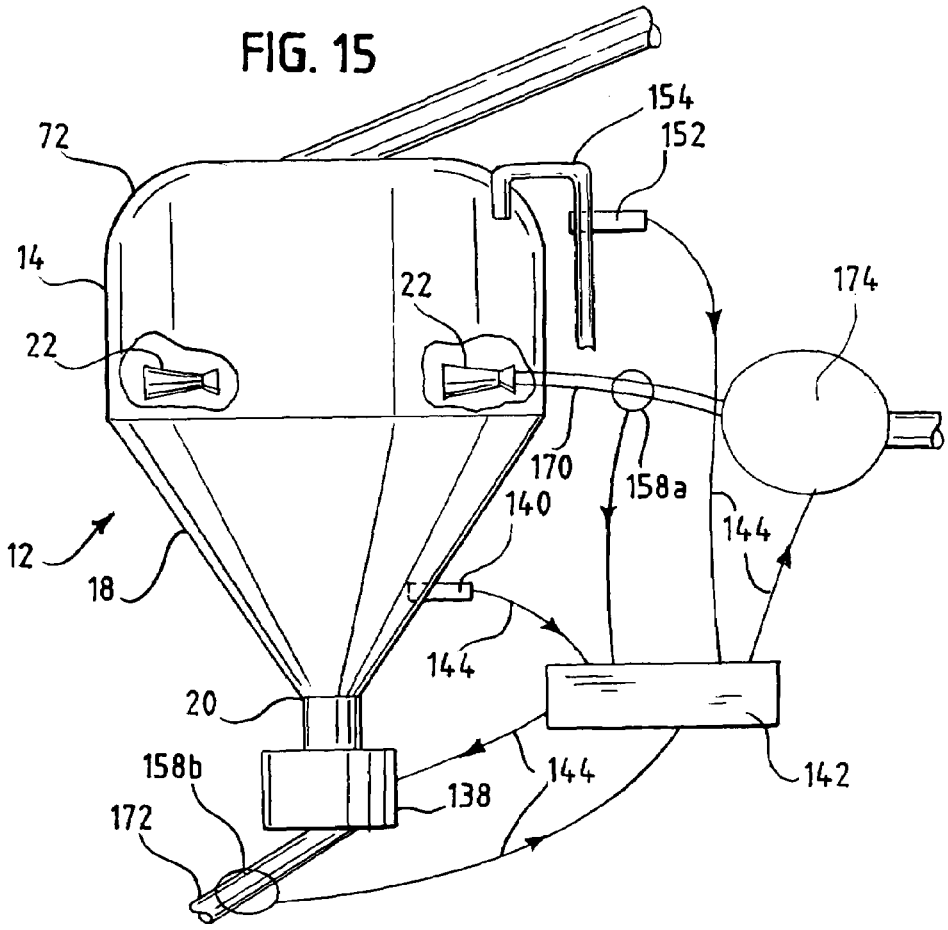

FIG. 15 shows a flotation apparatus including additional auxiliary apparatus for controlling a froth flotation process, with cutaways showing mixing eductors 22 disposed in the vessel. The auxiliary apparatus further includes an overflow sensor 152 disposed in an overflow drain conduit 154 in fluid communication and operational relationship with the interior of the vessel 12, and flow sensors 158*a* and 158*b* disposed in operational relationship with a feed conduit 170 to one or more mixing eductors 22 and a drain conduit 172, respectively. The programmable controller 142 receives signals from the sensors and, when necessary, sends a signal to at least one of the control valve 138 to adjust the operational position of the control valve 138 to control outlet flow, and a feed pump 174 to adjust the rate of injection of pulp to control the level (not shown) of pulp in the vessel.

Figure 16:
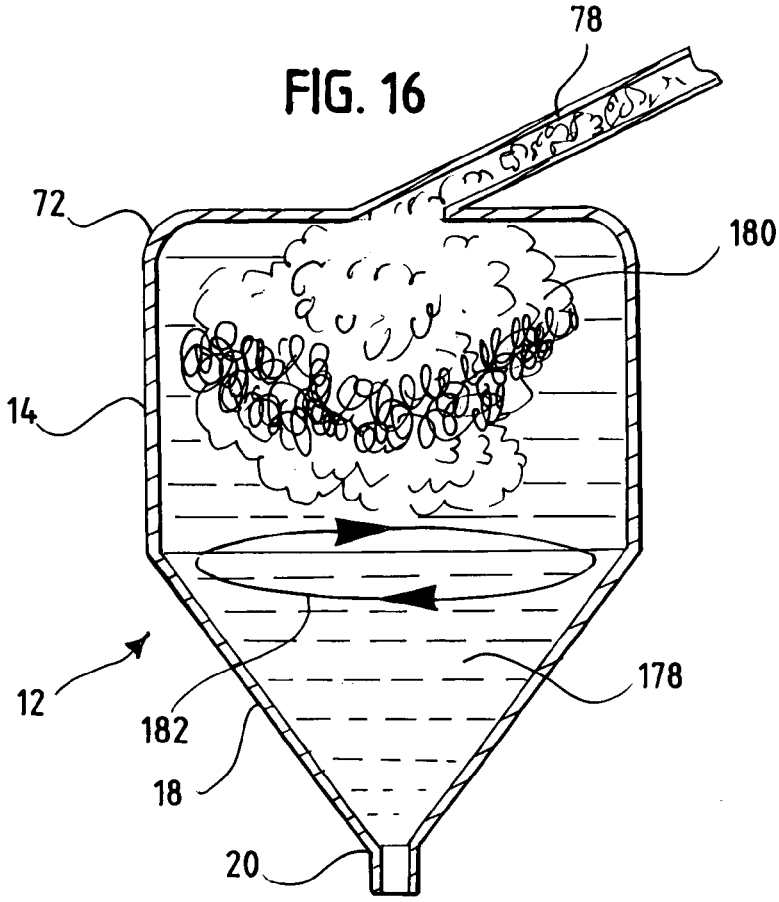
FIG. 16 is a cross-sectional view of a flotation apparatus in operation indicating locations of pulp and froth rotational movement of pulp within the vessel.

FIG. 16 is a cross-sectional view of a flotation apparatus in operation indicating locations of pulp 178 and froth 180 and the rotational movement of pulp 178 within the vessel shown by arrows 182.

Figure 17:
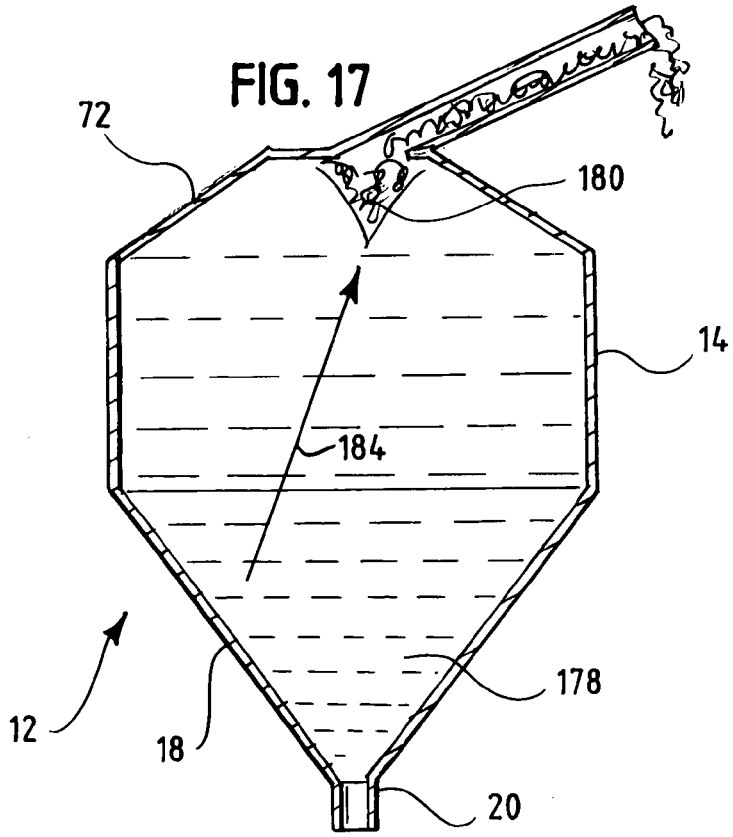
FIG. 17 is a cross-sectional view of a flotation apparatus in operation indicating a typical pressure vector within the vessel.
Figure 18:
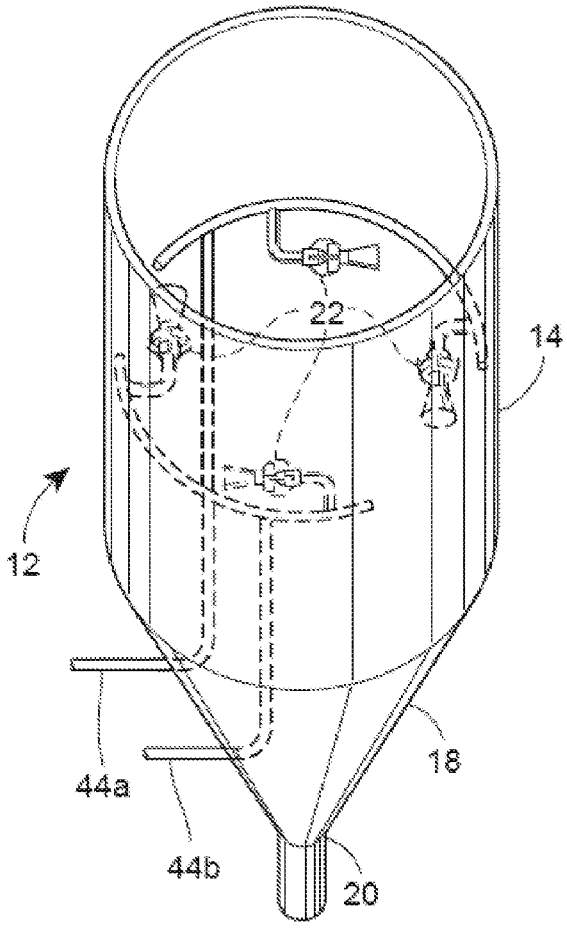
FIG. 18-19 are perspective views of additional inventive embodiments of a froth flotation apparatus with mixing eductors.
Figure 19:
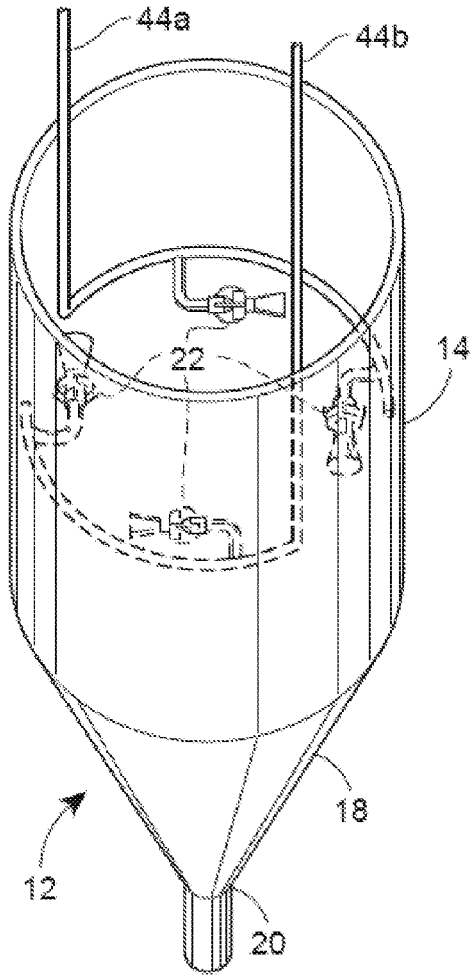

FIG. 17 is a cross-sectional view of a flotation apparatus in operation indicating locations of pulp 178 and froth 180 and a typical pressure vector 184 within the vessel from areas of relatively higher pressure to lower pressure.

A method of separating a desired constituent (e.g., coal) from a mixture of particulate matter is also contemplated. The method includes the steps of conditioning a liquid mixture of particulate matter including a desired constituent with a frothing agent to create a pulp and injecting the pulp into a vessel to impart net rotational movement, preferably net circular rotation, of pulp in the vessel. The method is contemplated to include embodiments including any combination of one or more of the additional optional steps, conditions, and features further described below (including those steps and features illustrated in the figures), unless stated otherwise.

The method preferably is performed continuously. In a preferred variant, the injecting step further includes entraining and mixing additional pulp from inside the vessel with the injected pulp. The method can include introducing pulp into the vessel in a non-injecting step, for example prior to startup of a continuous method. In another variant, pulp can be introduced in an injecting step during startup while preventing drainage of the pulp until the pulp rises to a desired level or until mixing of injected pulp with already-introduced pulp in the vessel occurs. Preferably, the ratio of entrained additional pulp to injected pulp is at least 1:20 (e.g., at least 1:10, 1:1, and more preferably at least 4:1).

If, for example, an eductor is designed to entrain four liters of pulp for every liter of pulp fed, the total discharge for each liter of feed is five liters. With a retention time in a vessel of ten minutes a hundred liter vessel would be fed ten liters per minute, which would mix fifty liters per minute—a rate of 50% of the total tank volume per minute. In one variant of the method, the injection velocity is at least 5% of the tank volume per minute, and preferably up to 600% of the tank volume per minute.

In a continuous method, the method can further include monitoring a property indicative of the surface level of the non-float fraction of the pulp (e.g., via at least one of a pressure sensor disposed in the vessel, such as in the liquid portion of the vessel in operation; a float sensor; a level sensor; and an overflow sensor), and can also further include controlling at least one rate selected from an injection rate of pulp and a withdrawal rate of pulp to control the surface level of the non-float fraction of pulp.

The method preferably includes a step of creating a zone of high pressure in the vessel surrounding (in at least two dimensions) a zone of relatively low pressure in the vessel. For example, the method can include injecting pulp around the interior periphery of a cylindrical vessel having a conical bottom to create a vortex having a circular zone of high pressure surrounding a zone of relatively lower pressure. Preferably, in three dimensions a series of such zones of relatively high and low pressure form a hydrocyclone. The radius of the zone of high pressure will decrease from the top of the cyclone to the bottom of the cyclone, such that low density froth is drawn upward to a low pressure zone at the top center of the vessel, surrounded to the sides and below by regions of high pressure. Put another way, the zone of relatively low pressure is preferably itself approximately conical in shape in one variant of the method.

The creation and use of such a pressure gradient can enhance separation of froth from pulp. In one embodiment, rotational motion creates a lower pressure zone at the center than at the walls of the vessel. Combined with the pressure gradient that extends from the bottom to the top of the vessel, the result is a diagonal force vector with the lowest force exerted on material a the top/center and the highest force exerted on material at the bottom/sides. These pressure differentials cause a separation of the material in the vessel by density, wherein the highest density material (generally the pulp) is forced to the sides and bottom, while the lower density material (froth) is allowed to travel to the center/top.

The method preferably includes a step of aerating the pulp to generate a float fraction of froth in a zone of relatively low pressure supported on the surface of a non-float fraction of pulp. The aerating step can include at least one of entraining a gas and injecting a gas, preferably air. The method also preferably includes a step of collecting froth from the float fraction in the zone of relatively low pressure. In one variant of the method, the pulp is aerated prior to injection into the floatation vessel. The method also preferably includes a step of mixing the pulp, more preferably after aeration. In one variant of the method, the pulp is aerated and then mixed prior to injection.

The method can also optionally include at least one step of draining collected froth and washing collected froth with a liquid to dislodge particles (e.g., non-selectively attached entrained, and entrapped particles) and recovering washed froth. The apparatus described herein and in Khan et al. U.S. patent application Ser. No. 10/306,131 (incorporated herein by reference) are particularly suited for performing such steps, although the method is not limited to any particular apparatus.

The throughput and efficiency of the flotation process can be controlled by adjusting at least one of the pulp feed rate, pulp level, retention time, circulating mass, reagent addition, and degree of aeration.

The apparatus and method described herein may have one or more of the following advantages, although the invention is not so limited. The intense mixing generated by the apparatus and method described herein provides for a relatively lower retention time as compared to conventional flotation cells, allowing for a greater throughput. The efficiency of mixing is expected to provide for lower power consumption and less maintenance. The design freedom with respect to materials of construction and ease of replacement may allow for longer equipment useful life (e.g., the vessel and/or related apparatus) by reducing the potential for corrosion.

The foregoing description is given for clearness of understanding only, and no unnecessary limitations should be understood therefrom, as modifications within the scope of the invention may be apparent to those having ordinary skill in the art. Throughout the specification, where compositions are described as including components or materials, it is contemplated that the compositions can also consist essentially of, or consist of, any combination of the recited components or materials, unless described otherwise.

What is claimed is:

1. A froth flotation apparatus, comprising a flotation vessel comprising a side wall, a top wall comprising a froth outlet, and a bottom wall comprising a fluid drain; and a mixing eductor comprising a primary fluid inlet and a secondary fluid inlet inside the vessel disposed to impart net rotational force to contents of the vessel about an axis of the vessel, in use, wherein the primary fluid inlet and the secondary fluid inlet are both disposed inside the vessel.

2. An apparatus according to claim 1, comprising a plurality of mixing eductors.

3. An apparatus according to claim 1, wherein the secondary fluid inlet of the mixing eductor has a fixed area.

4. An apparatus according to claim 1, wherein the vessel has a mean radius and the mixing eductor is disposed within the outer 70% of the mean radius of the vessel.

5. An apparatus according to claim 4, wherein the mixing eductor is disposed within the outer 40% of the mean radius of the vessel.

6. An apparatus according to claim 5, wherein the mixing eductor is disposed adjacent to the side wall.

7. An apparatus according to claim 5, wherein the mixing eductor is integral with the side wall.

8. An apparatus according to claim 1, wherein the mixing eductor is disposed with its outlet flow axis parallel to or tangential to the vessel wall.

9. An apparatus according to claim 1, wherein the mixing eductor is disposed with its outlet flow axis within 45 degrees of horizontal.

10. An apparatus according to claim 9, wherein the mixing eductor is disposed with its outlet flow axis within 15 degrees of horizontal.

11. An apparatus according to claim 10, wherein the mixing eductor is disposed with its outlet flow axis within 5 degrees of horizontal.

12. An apparatus according to claim 1, wherein the vessel has a mean interior height and the mixing eductor is disposed within the uppermost seven eighths of the mean interior height of the vessel.

13. An apparatus according to claim 12, wherein the mixing eductor is disposed within the uppermost one half of the mean interior height of the vessel.

14. An apparatus according to claim 13, wherein the mixing eductor is disposed within the uppermost one third of the mean interior height of the vessel.

15. An apparatus according to claim 1, free of mechanical mixers disposed in the vessel.

16. An apparatus according to claim 1, wherein the froth outlet intersects said axis.

17. An apparatus according to claim 1, wherein the top wall defines a raised top of the vessel.

18. An apparatus according to claim 17, wherein the raised vessel top is tapered.

19. An apparatus according to claim 17, wherein the raised vessel top has a curved profile.

20. An apparatus according to claim 1, wherein the bottom wall defines a depressed bottom of the vessel.

21. An apparatus according to claim 20, wherein the depressed vessel bottom is tapered.

22. An apparatus according to claim 20, wherein the depressed vessel bottom is conical with a mean half-cone angle in a range of 5 degrees to 85 degrees.

23. An apparatus according to claim 22, wherein the mean half-cone angle is in a range of 30 degrees to 75 degrees.

24. An apparatus according to claim 1, further comprising a feed conduit in fluid communication with the primary fluid inlet of the eductor and disposed parallel to the vessel side wall.

25. An apparatus according to claim 1, further comprising a feed conduit in fluid communication with the primary fluid inlet of the eductor and entering the vessel from above or below the eductor.

26. An apparatus according to claim 25, wherein the feed conduit enters the vessel through the vessel bottom wall.

27. An apparatus according to claim 1, further comprising at least one of a gas aspirator and a gas injector in fluid communication with the primary fluid inlet of the eductor.

28. An apparatus according to claim 27, wherein the gas aspirator is an air jet pump.

29. An apparatus according to claim 1, further comprising a static mixer in fluid communication with the primary fluid inlet of the eductor.

30. An apparatus according to claim 29, wherein the static mixer is a nonlinear section of conduit.

31. An apparatus according to claim 29, wherein the static mixer is a conduit comprising an internal constriction.

32. An apparatus according to claim 1, further comprising a deflector disposed within the vessel.

33. An apparatus according to claim 32, wherein the deflector is disposed in or adjacent the fluid drain.

34. An apparatus according to claim 1, wherein the vessel is constructed of plastic.

35. A froth flotation apparatus, comprising a flotation vessel comprising a side wall and a bottom wall comprising a fluid drain; and a plurality of mixing eductors each comprising a primary fluid inlet and a secondary fluid inlet inside the vessel disposed to impart net rotational force to contents of the vessel about an axis of the vessel, in use, wherein the primary fluid inlet and the secondary fluid inlet of each eductor are both disposed inside the vessel; and at least one of a gas aspirator and a gas injector in fluid communication with the primary fluid inlet of the eductor.

36. An apparatus according to claim 35, wherein the vessel has a mean radius and the mixing eductor is disposed within the outer 40% of the mean radius of the vessel.

37. An apparatus according to claim 36, wherein the mixing eductor is disposed adjacent to the side wall.

38. An apparatus according to claim 36, wherein the mixing eductor is integral with the side wall.

39. An apparatus according to claim 35, wherein the mixing eductor is disposed with its outlet flow axis parallel to or tangential to the vessel wall.

40. An apparatus according to claim 35, further comprising a vessel top wall, the top wall comprising a froth outlet.

41. An apparatus according to claim 40, wherein the froth outlet intersects said axis.

42. An apparatus according to claim 40, wherein the top wall defines a raised top of the vessel.

43. An apparatus according to claim 42, wherein the raised vessel top is tapered.

44. An apparatus according to claim 42, wherein the raised vessel top has a curved profile.

45. An apparatus according to claim 35, free of mechanical mixers disposed in the vessel.

* * * * *